US009882328B1

(12) United States Patent
Malcom et al.

(10) Patent No.: US 9,882,328 B1
(45) Date of Patent: Jan. 30, 2018

(54) CARTRIDGE HOLDER ASSEMBLY CONFIGURED TO HOLD CARTRIDGES IN AN UPRIGHT AND SIDE-BY-SIDE MANNER

(71) Applicant: Sumitomo Wiring Systems, Ltd., Yokkaichi, Mie (JP)

(72) Inventors: Bennie J. Malcom, Farmington Hills, MI (US); Ralph B. Alfeche, Farmington Hills, MI (US); Brian D. Carnick, Farmington Hills, MI (US)

(73) Assignee: Sumitomo Wiring Systems, Ltd., Yokkaichi-shi, Mie (JP)

( * ) Notice: Subject to any disclaimer, the term of this patent is extended or adjusted under 35 U.S.C. 154(b) by 0 days.

(21) Appl. No.: 15/373,648

(22) Filed: Dec. 9, 2016

(51) Int. Cl.
*H01R 13/60* (2006.01)
*H01R 33/945* (2006.01)
*H01R 33/92* (2006.01)

(52) U.S. Cl.
CPC ..... *H01R 33/945* (2013.01); *H01R 33/92* (2013.01); *H01R 2201/26* (2013.01)

(58) Field of Classification Search
CPC .. H01R 33/945; H01R 33/92; H01R 2201/26; H01M 2/1077; A47L 15/4454; H02J 7/1022
USPC ..... 439/533
See application file for complete search history.

(56) References Cited

U.S. PATENT DOCUMENTS

| | | | | |
|---|---|---|---|---|
| 6,206,234 | B1 * | 3/2001 | Rawlins | G07F 11/007 221/123 |
| 7,857,161 | B2 * | 12/2010 | Pinney | G06F 19/3462 221/10 |
| 9,024,572 | B2 * | 5/2015 | Nishihara | H01M 2/1077 320/107 |
| 9,308,829 | B2 * | 4/2016 | Matsuda | B62J 9/00 |
| 2001/0020838 | A1 * | 9/2001 | Malackowski | H02J 7/0022 320/116 |
| 2007/0184339 | A1 * | 8/2007 | Scheucher | H01M 2/1077 429/99 |
| 2008/0299798 | A1 | 12/2008 | Yoshida et al. | |
| 2012/0031930 | A1 * | 2/2012 | Fileccia | A47L 15/4454 222/325 |

FOREIGN PATENT DOCUMENTS

| | | | |
|---|---|---|---|
| JP | 2010063278 | A | 3/2010 |
| JP | 2012005312 | A | 1/2012 |
| JP | 2015008571 | A | 1/2015 |
| WO | 2011162171 | A1 | 12/2011 |

* cited by examiner

*Primary Examiner* — Jean F Duverne
(74) *Attorney, Agent, or Firm* — Dinsmore & Shohl LLP

(57) ABSTRACT

A cartridge holder assembly for use in an automotive vehicle is provided. The cartridge holder assembly is configured to hold a pair of cartridges in a generally upright and side-by-side manner. The cartridge holder assembly includes a housing having a pair of first side walls, a bottom wall, a front wall, a back wall so as to define an open top, and a partition generally parallel to and disposed between a pair of first side walls so as to define a first cartridge opening and a second cartridge opening, wherein the first and second cartridge opening are configured to receive a respective cartridge and hold the cartridges in an upright manner and side-by-side arrangement.

18 Claims, 9 Drawing Sheets

CARTRIDGE HOLDER ASSEMBLY CONFIGURED TO HOLD CARTRIDGES IN AN UPRIGHT AND SIDE-BY-SIDE MANNER

FIELD OF THE INVENTION

A cartridge holder assembly having vertical slots to provide access to a plurality of cartridges is provided.

BACKGROUND OF THE INVENTION

Cartridge holders may be used to hold a plurality of cartridges. Each cartridge includes electric components to include a Power Distribution Center (PDC). The PDC is currently used to distribute power to various vehicle functions. Cartridge holder assemblies are currently engineered accommodate cartridges configured to distribute power to specific electric devices. For instance, one design is used to manufacture a cartridge holder assembly configured to distribute power to a windshield wiper unit, headlamp unit and other vehicle functions generally found in all automotive vehicles, and another design is made for a cartridge holder assembly configured to distribute power to luxury vehicle functions such as a head rest positioning unit, a side mirror adjustment unit. Accordingly, the automotive designer currently designs different packaging space for a respective cartridge holder assembly as different editions of the same vehicle model include different electro-mechanical functions. For instance a limited edition of a model of an automotive vehicle may include automatic adjusting side mirrors which are not provided in a basic edition model of the automotive vehicle.

Furthermore, cartridge holder assemblies used in automotive vehicles compete for packaging space with other automotive components. Due to packaging constraints, servicing/replacing the PDC or the fuses may require the cartridge holder to be removed. This can add time and cost to the manufacturing and maintenance of the automotive vehicle. Currently, cartridge holders position cartridges in a stacked manner so as to require the worker to slide the cartridges in and out of the cartridge holder. However, such a configuration may not be desirable when the cartridge holder is mounted behind an instrument panel as the replacement of a malfunctioning cartridge may require the instrument panel to be removed.

Accordingly, it remains desirable to having a cartridge holder assembly having a housing configured to receive cartridges with different PDCs so as to allow the same housing design to support multiple editions of the same model which accommodates the differing vehicle functions without having to change the packaging requirements of the cartridge holder. Further, it remains desirable to have a cartridge holder assembly wherein the cartridges may be easily accessed for service and replacement.

SUMMARY OF THE INVENTION

A cartridge holder assembly for holding a plurality of cartridges in an upright and side-by-side manner is provided. The cartridge holder may be configured for use in an automotive vehicle. The cartridge holder assembly includes a housing having an open top and a partition generally parallel to and disposed between a pair of first side walls so as to define a first cartridge opening and a second cartridge opening. The first and second cartridge openings are configured to receive a respective cartridge and hold the cartridges in an upright manner and side-by-side arrangement.

The cartridges may be configured with different PDCs so as to provide power distribution to a predetermined arrangement of vehicle components. The cartridge includes a pair of second side walls, wherein one of the pair of second side walls includes at least one storage compartment open to the side of the respective second side wall. The storage compartment configured to receive an electric component such as a relay.

In one embodiment, the cartridge holder assembly includes an electric bar support. The electric bar support is shown disposed along front edge of the top portion of the front wall. The electric bar support includes a plurality of seats configured to hold a fuse and a bus bar. The bus bar electrically connects the fuses seated in respective electric bar supports to the PDCs in the respective cartridges.

Accordingly, the cartridge holder assembly is configured receive cartridges having different PDCs so as to support multiple editions of the same model without having to change the packaging requirements of the cartridge holder. Further, the cartridge holder assembly is configured to facilitate the service and replacement of a cartridge by providing a top down access to the cartridges.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

DETAILED DESCRIPTION OF THE PREFERRED EMBODIMENTS

A cartridge holder assembly for use in an automotive vehicle configured to hold a plurality of cartridges is provided. The cartridge holder assembly is configured to assist with the manufacturing process by preventing a change of packaging space to accommodate different vehicle functions available in different editions of a same model. Further, the cartridge holder assembly is configured to facilitate the service and repair of a malfunctioning cartridge by providing a top down access to the cartridges, which eliminates the need to remove an instrument panel in instances wherein the cartridge assembly is mounted adjacent an instrument panel.

Note that in the following description, the term top, bottom, front and back refer to the orientation of the cartridge holder assembly shown in FIG. 1.

The cartridge holder assembly includes a housing having a pair of first side walls, a bottom wall, a front wall and a back wall so as to define an open top. The cartridge holder assembly includes a partition generally parallel to and disposed between a pair of first side walls so as to define a first cartridge opening and a second cartridge opening. The first and second cartridge opening are configured to receive a respective cartridge and hold the cartridges in an upright manner and side-by-side arrangement.

The bottom wall of the housing includes a pair of open slots dimensioned to receive a bottom end of a respective cartridge. Though the description herein is made with respect to a housing with a single partition defining a first and second cartridge openings, it should be appreciated that the housing may include more partitions so as to define additional cartridge openings other than what is shown herein without departing from the scope of the appended claims.

The cartridge holder assembly may further include an electric bar support. The electric bar support is configured to hold a plurality of fuses and at least one eyelet terminal for connecting the cartridges to a power source. In one embodiment of an electric bar support, the electric bar support is shown disposed along front edge of the top portion of the front wall. The electric bar support includes a plurality of seats configured to hold a fuse.

A cartridge for use in a cartridge holder assembly is also provided. The cartridge holder includes a pair of second side walls, a second back wall, a second front wall, a second bottom wall and a second top wall. The second bottom wall and the second top wall include apertures for receiving a male terminal. One of the second side walls includes at least one storage compartment which is open so as to allow an electric component such as a relay to be installed or replaced.

Figure 1:
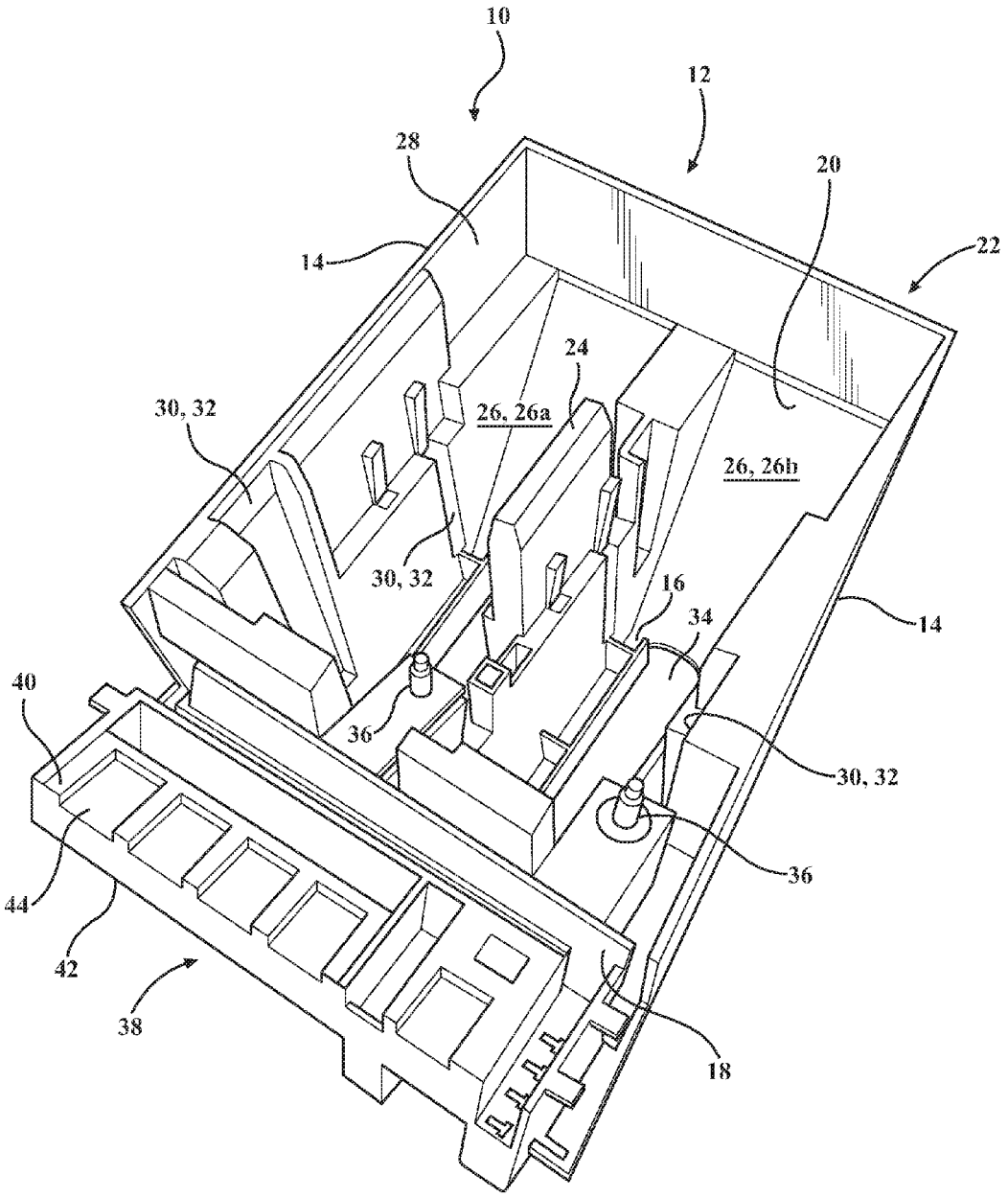
FIG. 1 is a perspective top view of an illustrative embodiment of a cartridge holder assembly.

With reference now to FIG. 1, a top down view of the cartridge holder assembly 10 is provided. The cartridge holder assembly 10 includes a housing 12. The housing 12 may be formed of a material suitable for injection molding. The housing 12 is configured to hold at least two cartridges 100. An illustrative embodiment of a cartridge 100 is shown in FIGS. 6-8 and FIG. 9 shows the cartridges 100 disposed in the housing 12. The housing 12 is includes a pair of first side walls 14 spaced apart from each other, a first bottom wall 16, a first front wall 18 and a first back wall 20 so as to define an open top 22.

The cartridge holder assembly 10 includes a partition 24. The partition 24 is illustratively shown as a generally planar member. The partition 24 is generally parallel to and disposed between a pair of first side walls 14 so as to define a cartridge opening 26. In particular, the partition 24 defines a first cartridge opening 26*a* and a second cartridge opening 26*b*.

The first and second cartridge openings 26*a*, 26*b* are slots that are disposed along a generally vertical axis when the housing 12 is mounted to the automotive vehicle (not shown). The first and second cartridge openings 26*a*, 26*b* are illustratively shown as being generally the same in dimension, in such an embodiment, the cartridges 100 have the same shape and features may be installed in either the first or second cartridge openings 26*a*, 26*b*. The first and second cartridge openings 26*a*, 26*b* are configured to receive a respective cartridge 100 and hold the cartridge 100 in an upright manner and side-by-side arrangement. It should be appreciated that as the housing 12 has an open top 22, removal of a cartridge 100 for replacement or repair is made simple.

In another embodiment, the first and second cartridge openings 26*a*, 26*b* may have different dimensions and thus respective cartridges 200 may be dimensioned differently from each other. In such an embodiment, the first and second cartridge openings 26*a*, 26*b* may have a keying feature so as to exclusively permit the registration of a particular cartridge. Thus, the cartridge holder is configured to facilitate the proper installation of cartridges in a respective first and second cartridge openings 26*a*, 26*b*.

The first side walls 14 include an inner surface 28 defining the first and second cartridge openings 26*a*, 26*b*. The inner surface 28 includes first guide features 30 for guiding a respective cartridge 100 into a proper position. For instance, the inner surface 28 of each of the first side walls 14 show first guide features 30 being a pair of grooves 32 formed along a front portion of respective first side walls 14. The pair of grooves 32 generally extends along a vertical axis and each groove 32 may be spaced apart and parallel to each other.

FIG. 1 shows the one groove 32 being wider than the other. Such a feature may be desirable to ensure that the cartridge 100 fits in a respective first or second cartridge opening 26*a*, 26*b* in only one manner. Thus, the grooves 32 cooperate with the cartridge 100 to ensure that cartridges 100 are properly installed.

Figure 2:
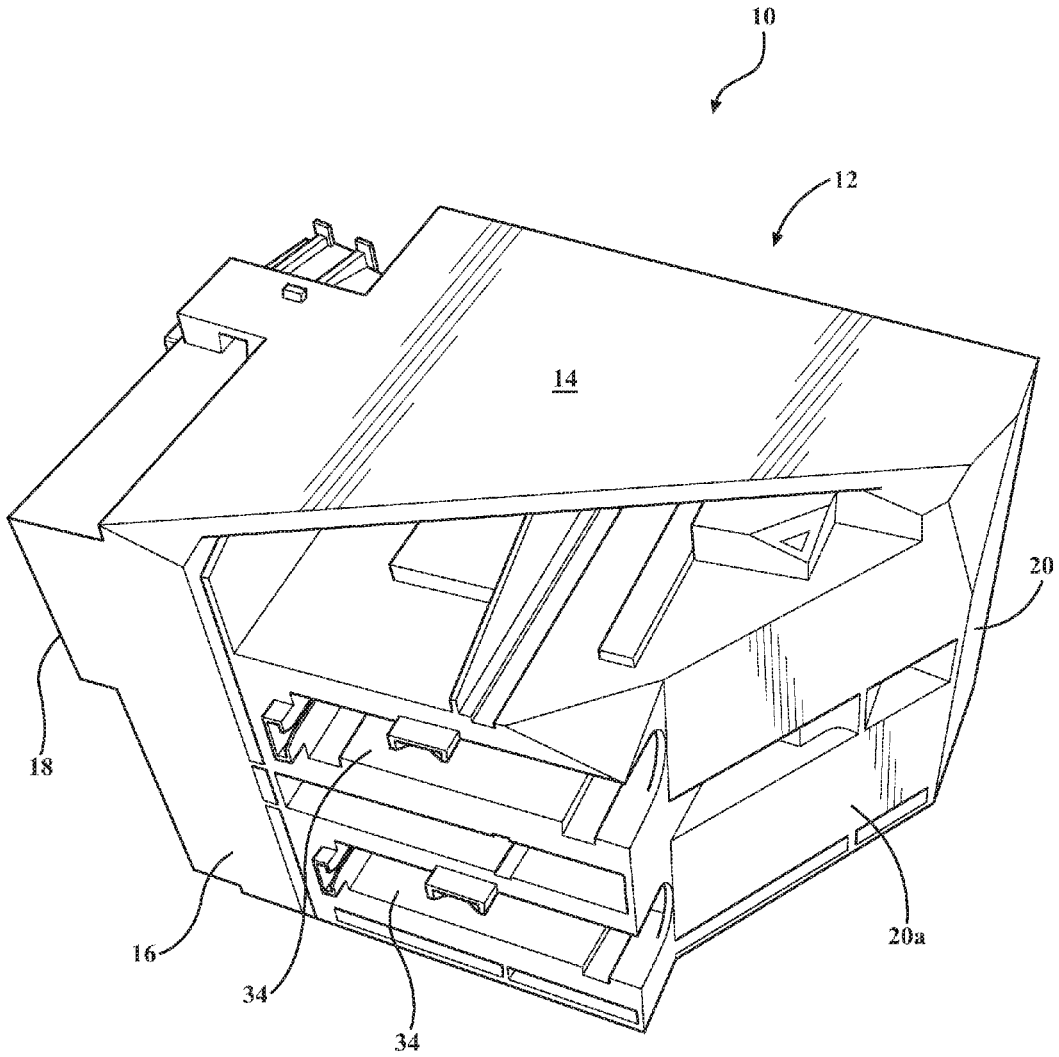
FIG. 2 is a perspective bottom view of the cartridge holder assembly shown in FIG. 1 taken at an angle.
Figure 3:
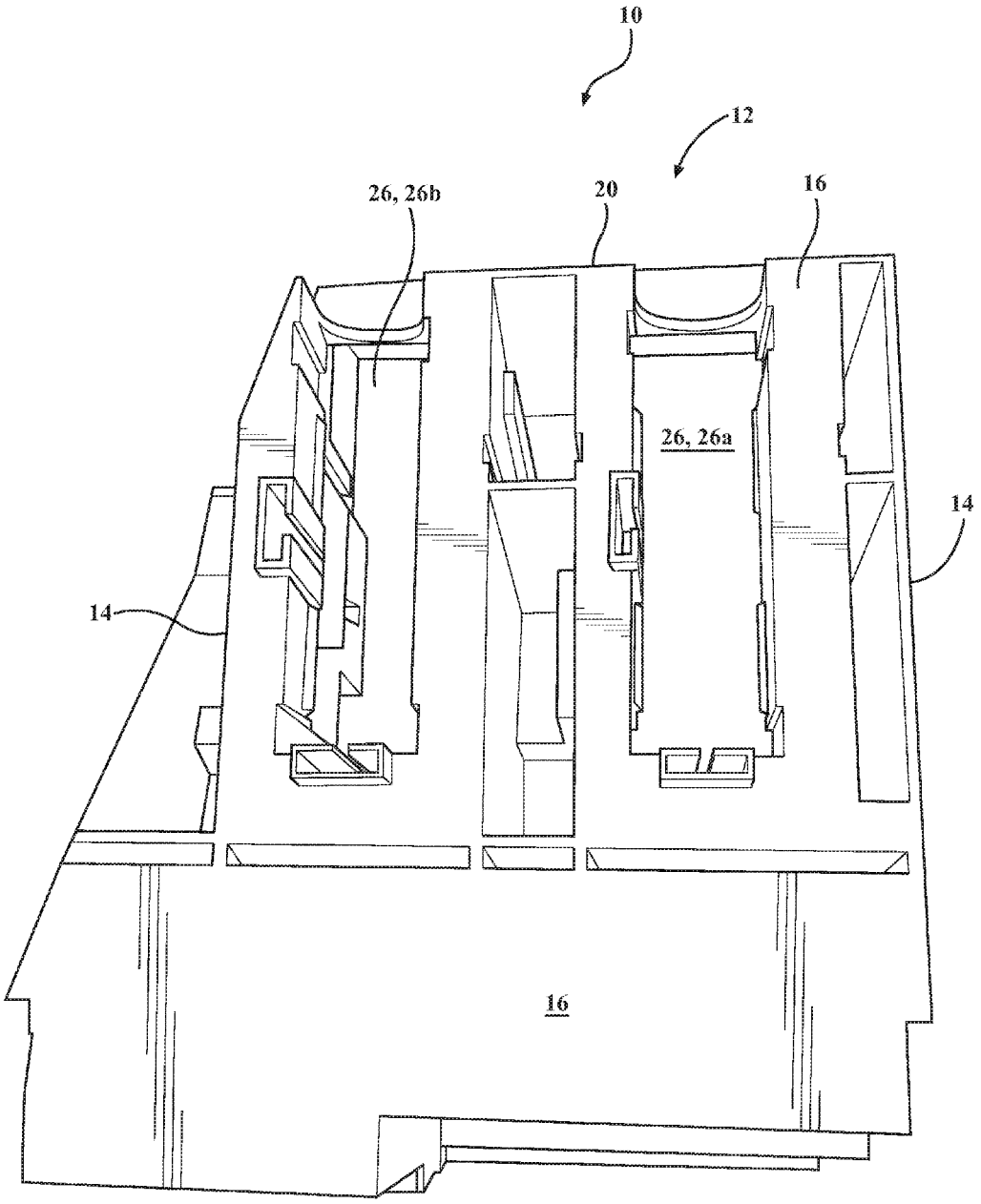
FIG. 3 is a bottom view showing the bottom openings of the housing.
Figure 5:
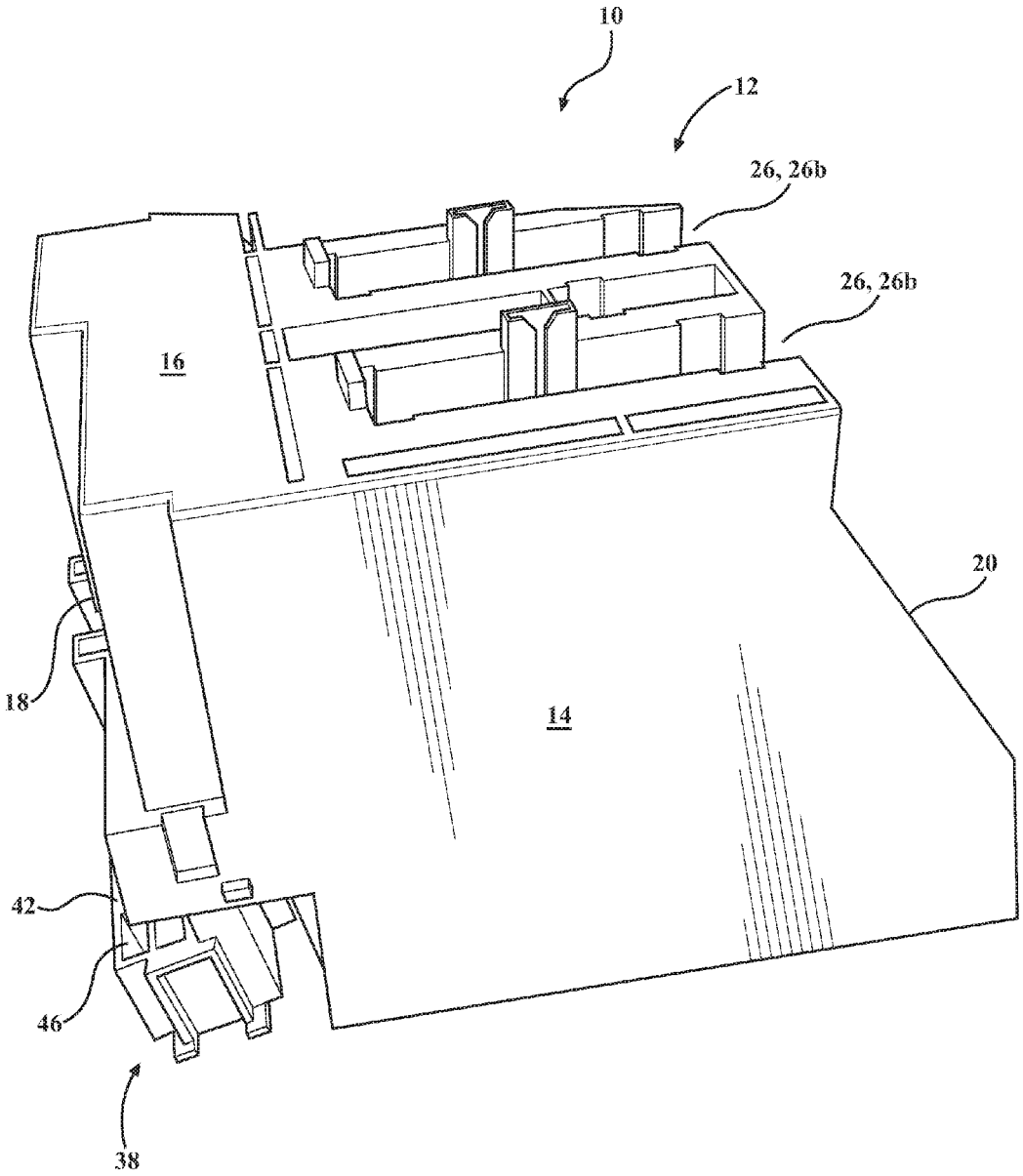
FIG. 5 is a perspective view showing a first side wall of the housing.

With reference now to FIGS. 2, 3 and 5 a perspective view showing the first bottom wall 16 of the housing 12 is provided. The first bottom wall 16 of the housing 12 includes a pair of bottom openings 34. The bottom openings 34 are configured to receive a bottom end of a cartridge 100 so as to allow the cartridges 100 to receive male terminals (not shown) so as to form an electric terminal connection. The housing 12 includes mating features 36 (shown in FIG. 1) for facilitating the attachment of the housing 12 to an automotive structure. FIG. 3 shows the bottom openings 34 being open to respective first and second cartridge openings 26*a*, 26*b*.

FIG. 2 shows an embodiment of the housing 12 wherein the first back wall 20 includes an angled surface 20*a*. The angled surface 20*a* is provided to accommodate a packaging space, accordingly, it should be appreciated that the dimensions and shape of the housing 12 is provided for illustrative purposes and is not limiting to the scope of the appended claims.

In one embodiment, the cartridge holder assembly 10 includes an electric bar support 38. With reference again to FIGS. 1 and 5 and now to FIG. 4, an illustrative embodiment of the electric bar support 38 is provided. The electric bar support 38 is shown as a generally block shaped member having a top surface 40, shown in FIG. 1, opposite a bottom surface 42 shown in FIG. 4. The top surface 40 includes a plurality of indents 44 configured to seat a respective eyelet terminal 70 (shown in FIG. 9). Each eyelet terminal is configured to receive electric power from vis-à-vis a wire (not shown). The electricity is transmitted to the cartridges 100 vis-à-vis a busbar (not shown). For illustrative purposes, the electric bar support 38 is shown having five indents 44 each indent 44 is configured to hold an eyelet terminal.

Figure 4:
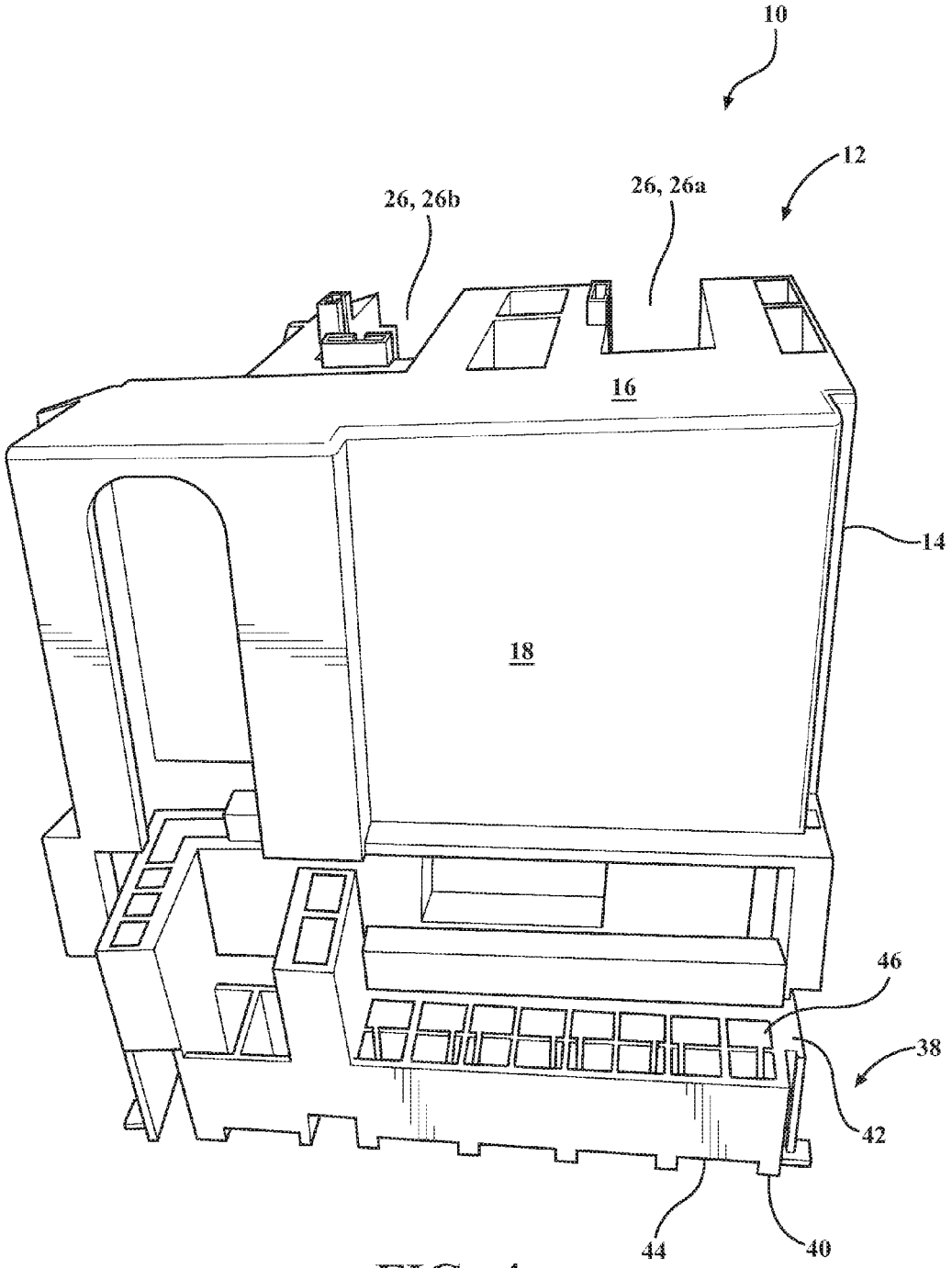
FIG. 4 is a bottom view of the housing showing the electric bar support.

With reference now to FIG. 4, the bottom surface 42 of the electric bar support 38 is shown. The bottom surface 42 of the electric bar support 38 includes a plurality of cavities 46. Each cavity 46 is shown having generally the same dimension for illustrative purposes. The cavity 46 is dimensioned to house a plurality of wire bundles (not shown) to provide power to various electric components disposed in respective first and second cartridge openings 26*a*, 26*b*. Accordingly, it should be appreciated that the dimensions of the cavities 46 are provided for illustrative purposes and are not limiting to the scope of the appended claims. The electric component is installed into the respective cavity 46, and may receive electric power vis-à-vis the busbar.

Figure 6:
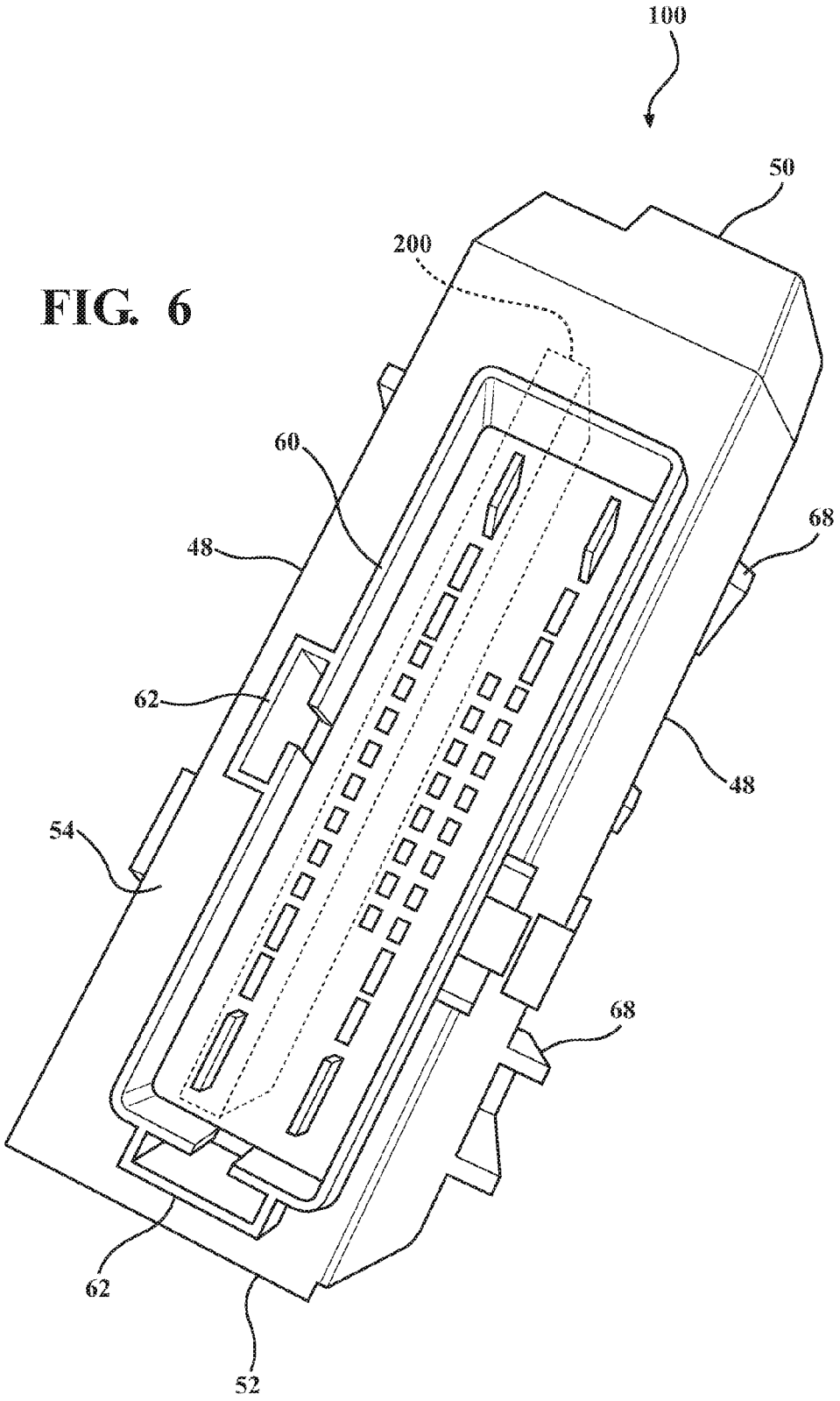
FIG. 6 is bottom view of a cartridge.
Figure 7:
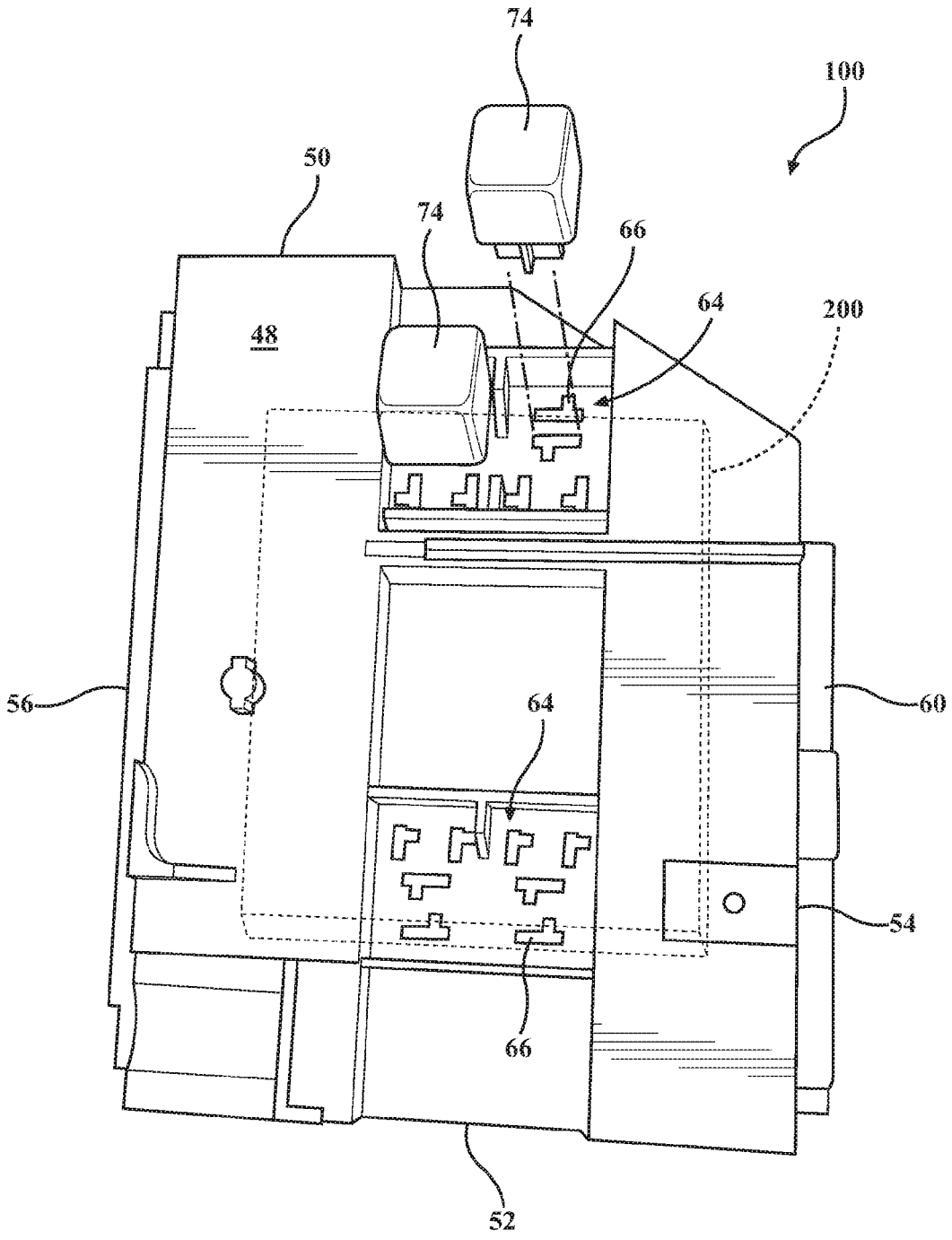
FIG. 7 is a side view of the cartridge shown in FIG. 6 showing the storage compartment.
Figure 8:
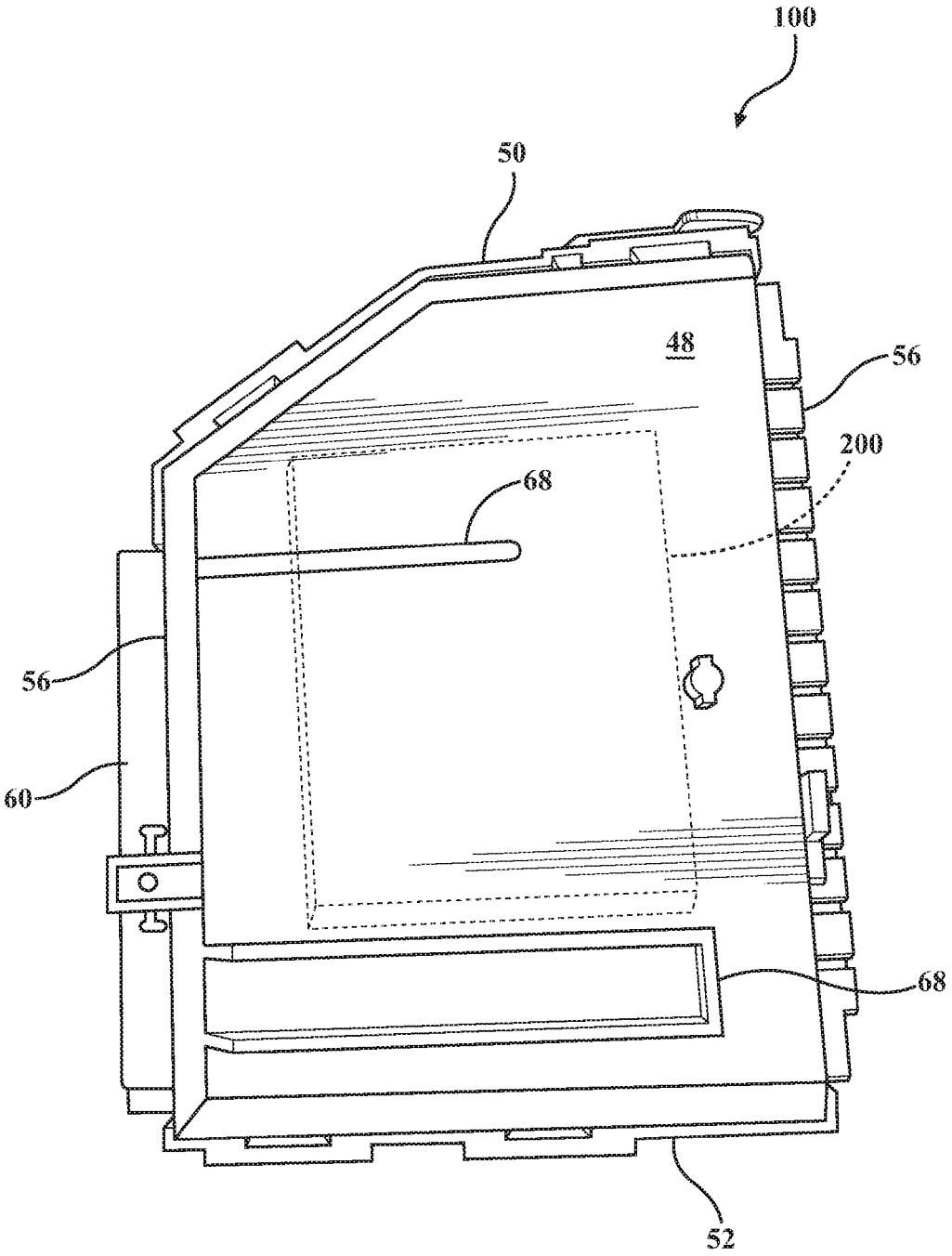
FIG. 8 is a side view of the cartridge shown in FIG. 7 taken from the opposite side.
Figure 9:
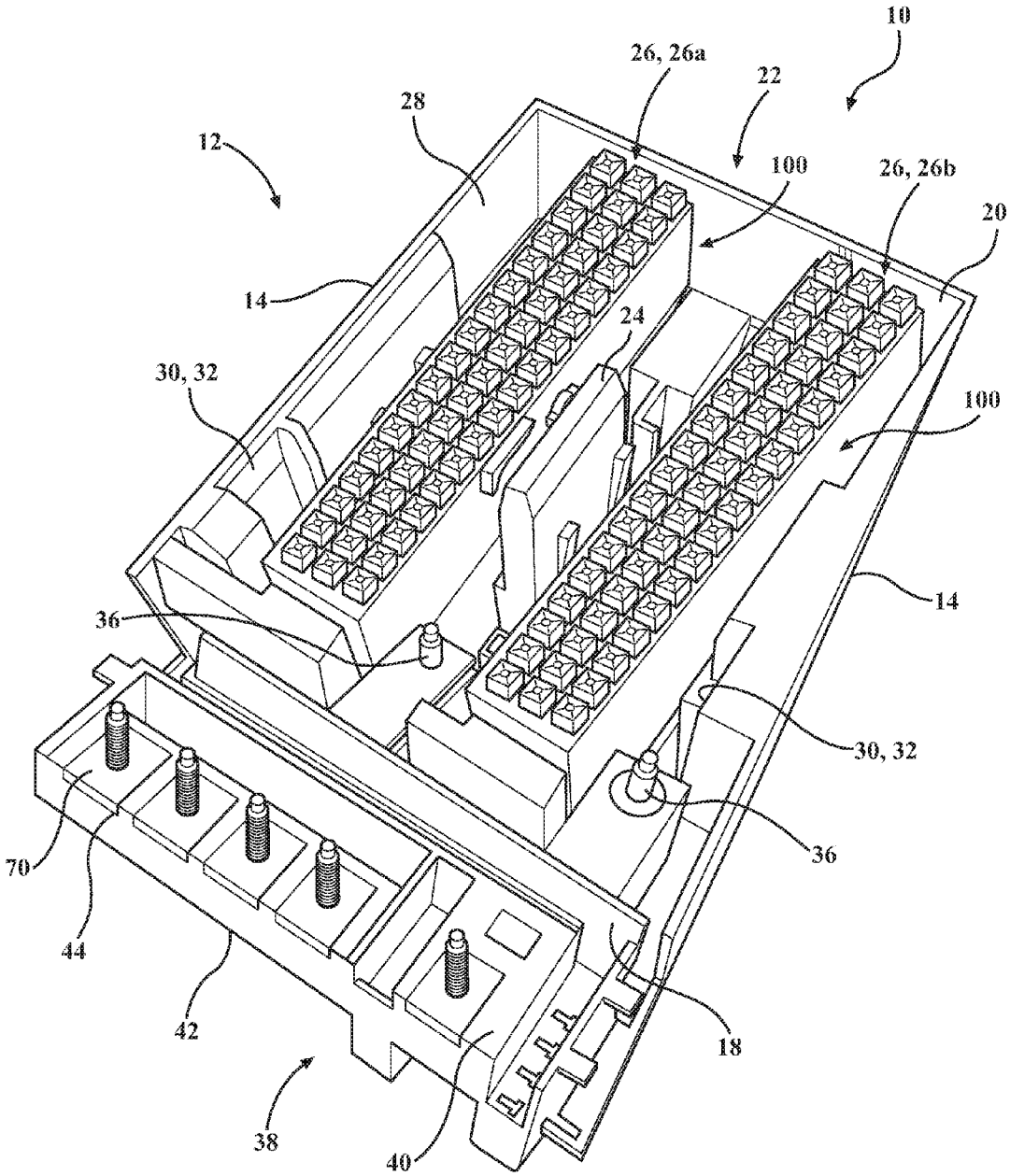
FIG. 9 is a top down view of a cartridge holder assembly holder showing one of the cartridge openings occupied by a cartridge.

With reference now to FIGS. 6-8 a cartridge 100 for use in the cartridge holder assembly 10 is also provided. The cartridge 100 includes a pair of second side walls 48, a second back wall 50, a second front wall 52, a second bottom wall 54 and a second top wall 56. The second bottom wall 54 and the second top wall 56 include apertures 58 for receiving a male terminal of an electric connector (not shown). The cartridge 100 is dimensioned to seat within a respective first or second cartridge opening 26*b*.

In one embodiment, the cartridge 100 is configured to hold a PDC 200. The PDC is disposed within a space bound by the pair of second side walls 48, the second back wall 50, the second front wall 52, the second bottom wall 54 and the second top wall 56. In one embodiment, the PDC 200 is configured to distribute power to a predetermined number of vehicle electric components (not shown). For instance, one cartridge 100 may have a PDC 200 configured to distribute power to a windshield wiper unit, a door lock unit and a head lamp unit, yet another cartridge 100 may have a PDC 200 configured to distribute power to a seat adjustment unit and a side mirror adjustment unit, and yet another cartridge 100 may have a PDC 200 configured to distribute power to a seat adjustment unit, a side mirror adjustment unit, a head rest adjustment unit and a seat heater unit.

FIG. 6, a view showing the second bottom wall 54 of an exemplary embodiment of a cartridge 100 is provided. The second bottom wall 54 includes a lip 60 bounding a plurality of apertures 58. The lip 60 is a generally planar member orthogonal to the second bottom wall 54. The lip 60 is generally dimensioned to slidingly fit within a bottom opening 34 of the first bottom wall 16 of the housing 12. The lip 60 is further configured to bound the electric terminal connection in the apertures 58 so as to help shield the electrical connection from damage. It should be appreciated that the electrical terminal connection may be formed by the coupling of a male blade into a female terminal. In this particular embodiment, male blades are configured to slide into respective apertures 58.

FIG. 6 also provides an illustrative view of a second guide feature 62. The second guide feature 62 is configured to help guide the cartridge 100 into proper position within a respective cartridge opening 26. For illustrative purposes, the second bottom wall 54 is shown having two second guide features 62 forming a cubic cavity. The second guide features 62 are disposed on portions of the lip 60 which are generally orthogonal to each other. Such an arrangement also helps ensure that the cartridge 100 is seated in a predetermined manner in that the second guide features 62 will prevent the lip 60 from being seated within a bottom opening 34 in the event the cartridge 100 is not oriented properly.

With reference now to FIGS. 7 and 8 the second walls are shown. FIG. 7 provides an illustrative embodiment of a storage compartment 64 disposed on one of the second side walls 48. The storage compartment 64 is a recess formed on the second side wall 48 having a depth dimensioned to fit an electric component 74. Preferably, the electric component is seated within the storage compartment 64 so as to be disposed beneath plane defining the outer surface of the second side wall 48.

In one aspect, the cartridge 100 includes a pair of storage compartments 64. Each storage compartment 64 is configured to house an electric component such as a relay or a fuse. Through-holes 66 allow for an electric connection between the electric component and the PDC 200. In this example, the through-holes 66 allow for a blade top pass through and connect to a printed circuit board which forms part of the PDC 200. In particular, the through-holes 66 are configured to receive a pin or male terminal of the electric component.

FIG. 8 is a depiction of the second side wall 48 opposite the second side wall 48 shown in FIG. 7. The second side wall 48 shown in FIG. 8 includes a guide member 68 configured to engage the first guide feature 30. For illustrative purposes, the second side wall 48 is shown as having a pair of guide members 68. The guide member 68 is configured to seat within corresponding first guide features 30 disposed on the inner surface 28 of the housing 12. FIG. 8 depicts the guide members 68 being dimensioned differently from each other.

The guide members 68 cooperate with the first guide features 30 to ensure that the cartridge 100 fits within a cartridge opening 26 in a predetermined manner. For instance, one guide member 68 is shown as being a wall protecting generally orthogonally from the second side wall 48 and forming a "U", while the other guide member 68 is a planar member projecting generally orthogonally from the second side wall 48 along an axis.

FIGS. 7 and 8 show the second back wall 50 of the cartridge 100 having an angled portion which is configured to conform with the angled portion of the first back wall 20 so as to again help ensure a proper seating of the cartridge 100 within the cartridge opening 26, and ensure that the cartridge 100 is installed in a predetermined orientation.

The cartridge holder assembly 10 may be used in an automotive vehicle. The cartridge holder assembly 10 may be dimensioned to fit within a predetermined packaging space of the automotive vehicle. For instance, the cartridge holder assembly 10 may be mounted behind the instrument panel of the automotive vehicle. The cartridge holder assembly 10 is installed with the open top 22 exposed so as to allow the installer to easily install cartridges 100 into respective cartridge openings 26. Further, as the cartridges 100 are the same in dimension but can have different PDCs 200, the same cartridge holder assembly 10 may be used for any edition of a model of an automotive vehicle, which eliminates the need to design different packaging space for the different vehicle functions provided in different editions of a model of an automotive vehicle.

As an example, the same cartridge holder assembly 10 may be used in a base and limited edition of a particular vehicle model. The base edition of the model may have a windshield wiper unit, a door lock unit, a head lamp unit, a seat adjustment unit and a side mirror adjustment unit. Whereas, the limited edition of the model may include all of the vehicle functionality of the base edition and also a head rest adjustment unit and a seat heater unit.

Workers assembling the base model may simply install a cartridge 100 having a PDC 200 configured to distribute power to a windshield wiper unit, a door lock unit and a head lamp unit into one cartridge opening 26 and another cartridge 100 having a PDC 200 configured to distribute power to a seat adjustment unit and a side mirror adjustment unit into the other cartridge opening 26.

Whereas a worker assembling the limited edition of the same model may simply install a cartridge 100 having a PDC 200 configured to distribute power to a windshield wiper unit, a door lock unit and a head lamp unit into one cartridge opening 26 and another cartridge 100 having a PDC 200 configured to distribute power to a seat adjustment unit, a side mirror adjustment unit, a head rest adjustment unit and a seat heater unit into the other cartridge opening 26. In either case, the same cartridge holder assembly 10 is used, and thus that packaging requirements for the base edition and the limited edition need not be changed with respect to the cartridge holder assembly 10.

Further, it should be appreciated that the open top 22 provides easy access to the cartridges 100 so as to facilitate the replacement or repair of the cartridges 100. Further, the cartridges 100 themselves may be easily serviced in the event a fuse or relay malfunctions. In particular, the storage compartments 64 are open on the second side wall 48 of the cartridge 100 and thus the worker may simply extract the malfunctioning relay or fuse and replace the malfunctioning relay or fuse with a functioning relay or fuse.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

We claim:

1. A cartridge holder assembly for use in an automotive vehicle, the cartridge holder assembly configured to hold a pair of cartridges, the cartridge holder assembly comprising:

a housing having a pair of first side walls, a first bottom wall having a bottom opening, a first front wall and a first back wall so as to define an open top; and a partition generally parallel to and disposed between the pair of first side walls and dividing the bottom opening so as to define a first cartridge opening and a second cartridge opening, the first and second cartridge openings extending through the first bottom wall and into the open top, a guiding feature disposed on an inner surface of the housing, wherein the first cartridge opening and the second cartridge opening are configured to receive a respective cartridge and wherein the guiding features are configured to hold the cartridge in an upright manner and side-by-side arrangement so as to place a second bottom wall of the pair of cartridges beyond the first bottom wall exposing the second bottom wall of the pair of cartridges and making available the pair of cartridges to receive a terminal connection.

2. The cartridge holder assembly as set forth in claim 1, wherein the first cartridge opening and the second cartridge opening are disposed along a generally vertical axis when the housing is mounted to the automotive vehicle.

3. The cartridge holder assembly as set forth in claim 1, wherein the first bottom wall of the housing includes a pair of bottom openings dimensioned to receive a bottom end of a respective cartridge.

4. The cartridge holder assembly as set forth in claim 1, further including an electric bar support, the electric bar support is configured to hold a plurality of electric components and at least one eyelet terminal.

5. The cartridge holder assembly as set forth in claim 4, wherein the electric bar support is a generally block shaped member having a top surface opposite a bottom surface, the top surface includes a plurality of indents configured to seat a respective eyelet terminal and the bottom surface includes a plurality of cavities, each of the plurality of cavities is dimensioned to house an electric component.

6. A cartridge for use in a cartridge holder assembly, the cartridge comprising:

a pair of second side walls, a second back wall, a second front wall, a second bottom wall and a second top wall, the second bottom wall having apertures for receiving a terminal connection and wherein the second bottom wall is orthogonal to the pair of second side walls;

a power distribution circuit disposed within a space bound by the pair of second side walls, the second back wall, the second front wall, the second bottom wall and the second top wall; and a storage compartment disposed on one of the pair of second side walls, the storage compartment configured to hold an electric component.

7. The cartridge as set forth in claim 6, wherein the storage compartment is a pair of storage compartments.

8. The cartridge as set forth in claim 7, wherein the storage compartment is a recess formed on one of the pair of second side walls having a depth dimensioned to fit the electric component.

9. The cartridge as set forth in claim 8, wherein the storage compartment includes through-holes to allow for an electric connection between the electric component and the power distribution circuit.

10. A cartridge holder assembly for use in an automotive vehicle, the cartridge holder assembly comprising:

a pair of cartridges, each of the pair of cartridges having a pair of second side walls, a second back wall, a second front wall, a second bottom wall and a second top wall, the second bottom wall having apertures for receiving a terminal connection and wherein the second bottom wall is orthogonal to the pair of second side walls;

a power distribution circuit disposed within a space bound by the pair of second side walls, the second back wall, the second front wall, the second bottom wall and the second top wall;

a housing having a pair of first side walls, a first bottom wall having a bottom opening, a first front wall and a first back wall so as to define an open top;

a partition generally parallel to and disposed between the pair of first side walls and dividing the bottom opening so as to define a first cartridge opening and a second cartridge opening, the first and second cartridge openings extending through the first bottom wall and into the open top, a guiding feature disposed on an inner surface of the housing, wherein the first cartridge opening and the second cartridge opening are configured to receive a respective one of the pair of cartridges and wherein the guiding features are configured to hold the pair of cartridges in an upright manner and side-by-side arrangement so as to place the second bottom wall of the pair of cartridges beyond the first bottom wall exposing the second bottom wall of the pair of cartridges and making available the pair of cartridges to receive the terminal connection.

11. The cartridge holder assembly as set forth in claim 10, wherein each of the pair of cartridges includes a storage compartment disposed on one of the pair of second side walls, the storage compartment configured to hold an electric component.

12. The cartridge holder assembly as set forth in claim 11, each of the pair of first side walls includes an inner surface having a first guide feature, and one of the pair of second side walls includes a guide member configured to engage the first guide feature so as to cooperate with the first guide feature to ensure each of the pair of cartridges fits within respective first and second cartridge openings in a predetermined manner.

13. The cartridge holder assembly as set forth in claim 12, wherein the first guide feature is a pair of grooves formed along a front portion of respective first side walls, the pair of grooves generally extends along a vertical axis and each of the pair of grooves may be spaced apart and parallel to each other.

14. The cartridge holder assembly as set forth in claim 13, wherein one of the pair of grooves is wider than the other.

15. The cartridge holder assembly as set forth in claim 11, wherein the first bottom wall of the housing includes a pair of bottom openings dimensioned to receive a bottom end of a respective cartridge and the second bottom wall includes a lip generally dimensioned to slidingly fit within a respective one of the pair of bottom openings.

16. The cartridge holder assembly as set forth in claim 11, further including an electric bar support, the electric bar support is configured to hold a plurality of electric components and at least one eyelet terminal.

17. The cartridge holder assembly as set forth in claim 16, wherein the electric bar support is a generally block shaped member having a top surface opposite a bottom surface, the top surface includes a plurality of indents configured to seat a respective eyelet terminal and the bottom surface includes a plurality of cavities, each of the plurality of cavities is dimensioned to house the electric component.

18. The cartridge holder assembly as set forth in claim 10, wherein each of the pair of cartridges includes a plurality of apertures disposed on the second top wall and the second bottom wall, the plurality of apertures for receiving a male terminal.

* * * * *